US010518401B2

(12) United States Patent
Li

(10) Patent No.: US 10,518,401 B2
(45) Date of Patent: Dec. 31, 2019

(54) HAND TOOL WITH RELIABLE CONNECTIONS

(71) Applicants: HANGZHOU GREAT STAR TOOLS CO., LTD., Hangzhou, Zhejiang Province (CN); HANGZHOU GREAT STAR INDUSTRIAL CO., LTD., Hangzhou, Zhejiang Province (CN)

(72) Inventor: Yueming Li, Hangzhou (CN)

(73) Assignees: HANGZHOU GREAT STAR TOOLS CO., LTD., Hangzhou (CN); HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 96 days.

(21) Appl. No.: 15/548,954

(22) PCT Filed: Feb. 6, 2015

(86) PCT No.: PCT/CN2015/072368
§ 371 (c)(1),
(2) Date: Aug. 4, 2017

(87) PCT Pub. No.: WO2016/123784
PCT Pub. Date: Aug. 11, 2016

(65) Prior Publication Data

US 2018/0029213 A1 Feb. 1, 2018

(51) Int. Cl.
*B25F 1/00* (2006.01)
*B25G 3/26* (2006.01)
(Continued)

(52) U.S. Cl.
CPC ..... *B25F 1/006* (2013.01); *B25G 1/102* (2013.01); *B25G 3/14* (2013.01); *B25G 3/26* (2013.01); *B25G 3/28* (2013.01)

(58) Field of Classification Search
CPC . B25F 1/006; B25F 1/00; B25G 1/102; B25G 3/14; B25G 3/26; B25G 3/28;
(Continued)

(56) References Cited

U.S. PATENT DOCUMENTS 5,251,352 A * 10/1993 Cullison ..... B25F 1/04 30/169
5,956,799 A * 9/1999 Panaccione ..... A47L 13/022 15/143.1
(Continued)

FOREIGN PATENT DOCUMENTS

CN 101505923 A 8/2009
CN 102069485 A 5/2011
(Continued)

OTHER PUBLICATIONS

International Search Report (English-Chinese, 4 pp.) for App. No. PCT/CN2015/072368 dated Oct. 8, 2015.

*Primary Examiner* — Robert J Scruggs
(74) *Attorney, Agent, or Firm* — Fitch, Even, Tabin & Flannery LLP

(57) ABSTRACT

A hand tool with reliable connections comprises: a working unit having a working end and a handle end opposite to the working end; a handle being mounted on the handle end of the working unit and having a working unit end and a knocking unit end; a knocking unit being mounted on the knocking unit end of the handle. The connecting part between the knocking unit and the handle end of the working unit is a contacting surface, the handle end or the contacting surface is configured as a deformable and non-rigid contact, realizing the reliable connection between the working unit and the knocking unit.

6 Claims, 4 Drawing Sheets

(51) Int. Cl.

| | |
|---|---|
| ***B25G 3/28*** | (2006.01) |
| ***B25G 3/14*** | (2006.01) |
| ***B25G 1/10*** | (2006.01) |

(58) Field of Classification Search
CPC .... B25G 3/00; B25G 1/10; B26B 3/00; B44C 7/08; B44C 7/00; A47L 13/022; B05C 17/10; B25B 13/22
See application file for complete search history.

(56) References Cited

U.S. PATENT DOCUMENTS

| | | | | |
|---|---|---|---|---|
| 6,182,317 | B1 * | 2/2001 | Huang | B25F 1/00 7/105 |
| 6,530,098 | B1 * | 3/2003 | Gringer | B25B 15/00 7/105 |
| 2008/0047074 | A1 | 2/2008 | Rosso et al. | |
| 2009/0084233 | A1 | 4/2009 | Rosso et al. | |
| 2009/0293200 | A1 | 12/2009 | Rosso et al. | |
| 2012/0036668 | A1 | 2/2012 | Farland et al. | |

FOREIGN PATENT DOCUMENTS

| | | | |
|---|---|---|---|
| CN | 204450467 | U | 7/2015 |
| DE | 3217788 | A1 | 11/1983 |
| DE | 102009005814 | A1 | 7/2010 |
| FR | 2791591 | A1 | 10/2000 |
| WO | 2013/137718 | A1 | 9/2013 |

* cited by examiner

HAND TOOL WITH RELIABLE CONNECTIONS

FIELD OF THE INVENTION

The present invention is related to a hand tool, particularly to a hand tool with reliable connections.

DESCRIPTION OF THE PRIOR ART

An ordinary hand tool, such as a scraper or a screwdriver, usually consists of a working unit and a handle. When in use, it often needs to knock. For instance, a protruded nail is encountered when a scraper is used to smooth a wall, the nail needs to be knocked into the wall in order to keep the surface of the wall smooth. Then, it will be convenient and time-efficient if the scraper can be used to knock.

When an ordinary hand tool is used to knock, the end part of the handle is the direct acting position and thus is easy to be damaged. In some hand tools, a knocking unit is provided at the end part of the handle, for example, in the wall scraper described in CN200780031592.1, the knocking unit is directly connected to the handle, thus the impact force can be transferred to the handle via the knocking unit and still damage the handle.

In addition, the working units in some hand tools with knocking units, such as the blade, will also directly come into contact with the knocking unit. However, due to many limiting parts used in the assembly, such as the engagement between the edge of the knocking unit and the end of the handle or the engagement between the mounting holes, the engagement between the working unit and the knocking unit is weakened thus the connection between the working unit and the knocking unit becomes unreliable. Although the precise engagements between each part can be achieved by improving the production precision of the parts, it will undoubtedly increase the production cost. When the connection between the working unit and the knocking unit is unreliable, the impact force applied to the knocking unit will still be transferred to the handle and damage the handle.

Therefore, for an ordinary hand tool, such as a scraper or a screwdriver, most of the impact force during knocking will be transferred to the handle and damage the handle due to the unreliable connections between parts.

SUMMARY OF THE INVENTION

The present invention provides a hand tool with reliable connections, comprising a working unit having a working end and a handle end opposite to the working end; a handle being mounted on the handle end of the working unit, the handle having a working unit end and a knocking unit end; a knocking unit being mounted on the knocking unit end of the handle. The connecting part between the knocking unit of the hand tool of the present invention and the handle end of the working unit is a contacting surface, the handle end or the contacting surface being configured as a deformable and non-rigid contact, realizing the reliable connection between the working unit and the knocking unit.

Furthermore, at least one of the contacting surface and the handle end is configured to be tooth-shaped, the tooth-shape can deform and form a gapless engagement with the contacting surface.

Furthermore, the knocking unit has a tongue part having a recess for accommodating part of the handle end, the closed end of the recess is the contacting surface.

Furthermore, the hand tool with reliable connections of the present invention further comprises a connecting unit for fixedly connecting the working unit and the knocking unit.

Furthermore, the handle end of the working unit has a through hole, the tongue part of the knocking unit has a through hole, the connecting unit is mounted in the through hole of the handle end and the through hole of the tongue part of the knocking unit.

Furthermore, the axis of the through hole of the handle end is offset from that of the through hole of the tongue part, when an external force is applied, the axis of the through hole of the handle end is in alignment with that of the tongue part because of the deformation of the tooth-shape.

Furthermore, the connecting unit mentioned above is a pin.

Furthermore, the tongue part of the knocking unit has two through holes that respectively situated on both sides of the recess of the tongue part and share a same axis.

Preferably, the handle end has a turnup part, the tongue part of the knocking unit has a through hole engaged with the turnup part, the working unit and the knocking unit are fixedly connected by the turnup part and the through hole.

Furthermore, the turnup part is configured to connect with the handle end of the working unit on the end close to the knocking unit and turn up from the working unit on the end away from the knocking unit.

Furthermore, the through hole is a square hole with a slope configured on the part contacting the turnup part.

Furthermore, when an external force is applied, the end turning up from the knocking unit of the turnup part displaces along the slope so as to fixedly connect the working unit and the knocking unit.

Preferably, a symmetric extended part is configured on the handle end of the working unit of the hand tool with reliable connections of the present invention, the extended part abuts the contacting surface of the knocking unit.

Furthermore, said extended part is configured to be tooth-shaped with single tooth or multiple teeth.

Furthermore, the hand tool with reliable connections of the present invention further comprises a riveting unit for fixedly connecting the handle and the knocking unit.

Furthermore, the knocking unit end of the handle has a mounting part having a through hole, the knocking unit has a through hole, the riveting unit is mounted in the through hole of the mounting part and the through hole of the knocking unit.

Furthermore, the through hole of the mounting part is offset from the through hole of the knocking unit, when an external force is applied, the axis of the through hole of the mounting part is in alignment with that of the through hole of the knocking unit.

Furthermore, the hand tool with reliable connections of the present invention further comprises an annular tube mounted in the through hole of the mounting part and the through hole of the knocking unit, the riveting unit is mounted in the annular tube and is configured to be capable of bearing the force transferred from the knocking unit.

Furthermore, the riveting unit is a rivet or a rivet tube.

Preferably, the working unit of the hand tool with reliable connections of the present invention is a blade.

Preferably, the material of the knocking unit of the handle is metal or high strength polymer.

In the hand tool with reliable connections of the present invention, a gapless and close engagement between the working unit and the knocking unit is achieved by the deformation of the contacting surface between the handle end of the working unit and the knocking unit. This configuration lowers the precision requirements for the production of each part of the hand tool. For instance, when the contacting surface of the knocking unit is configured to be a flat surface, if its flatness is not good or the extending direction has deviation, then the close engagement can be achieved by the deformation of the tooth-shape of the corresponding handle end face. This can effectively reduce the production costs and is beneficial for the fine-tuning of the product. Therefore, the hand tool of the present invention has reliable connections that can disperse the impact force and prolong the service life of the handle.

DETAILED DESCRIPTION OF THE PREFERRED EMBODIMENTS

Figure 1:
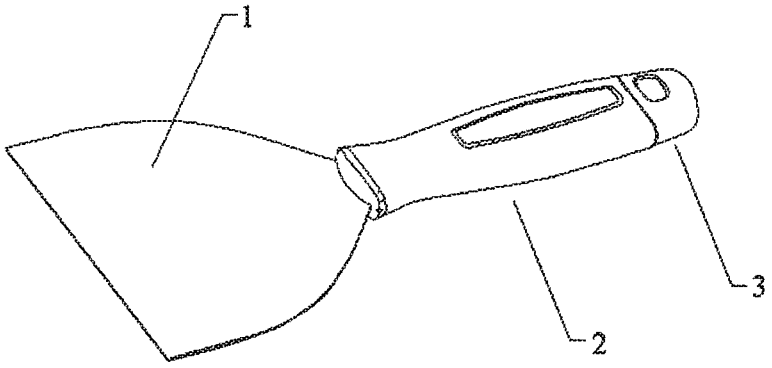
FIG. 1 is a schematic of a preferred embodiment of a scraper of the present invention.

FIGS. 1-6 show a hand tool with reliable connections in a preferred embodiment provided by the present invention, wherein a working part is a blade and the hand tool with reliable connections is a scraper. As shown in FIG. 1, the scraper comprises a blade 1, a handle 2 and a knocking unit 3. The assembly sequence of the scraper is: the handle 2 is first mounted onto the blade 1, the knocking unit is then mounted onto the handle 2 and the blade 1. Wherein, the blade 1 goes through the handle 2. The handle 2 can be formed onto the blade 1 by injection molding. It is known to a person skilled in the art that the forming and assembling methods of handles of ordinary tools can be applied to form the handle of the hand tool of the present invention.

Figure 2:
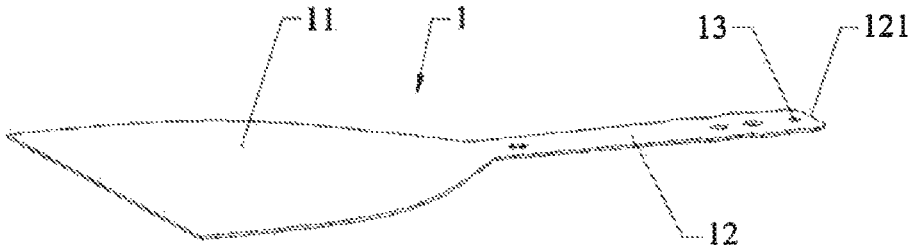
FIG. 2 is a schematic of the blade of the scraper of FIG. 1.

As shown in FIG. 2, the blade 1 has a working end 11 and a handle end 12 opposite to the working end 11. A through hole 13 is provided on the handle end 12, the tail end of the handle end 12 is a handle end face 121. The handle end face 121 is configured to be tooth-shaped.

Figure 3:
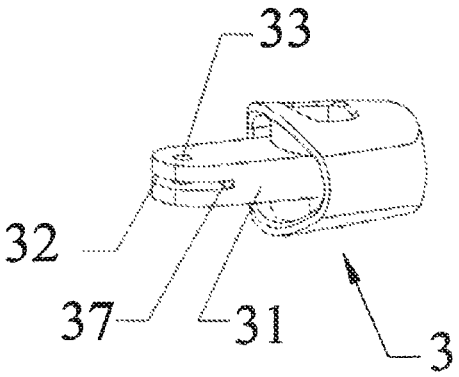
FIG. 3 is a schematic of the knocking unit of the scraper of FIG. 1.

As shown in FIG. 3, the knocking unit 3 comprises a tongue part 31 extending outward along the axis of symmetry, the tongue part 31 has a recess 32 at the end near the blade 1 for accommodating part of the handle end 12 of the blade 1. Through holes 33 are accordingly provided on the tongue part 31 on both sides of the recess 32. A closed end of the recess 32 is the contacting surface 37.

Figure 4:
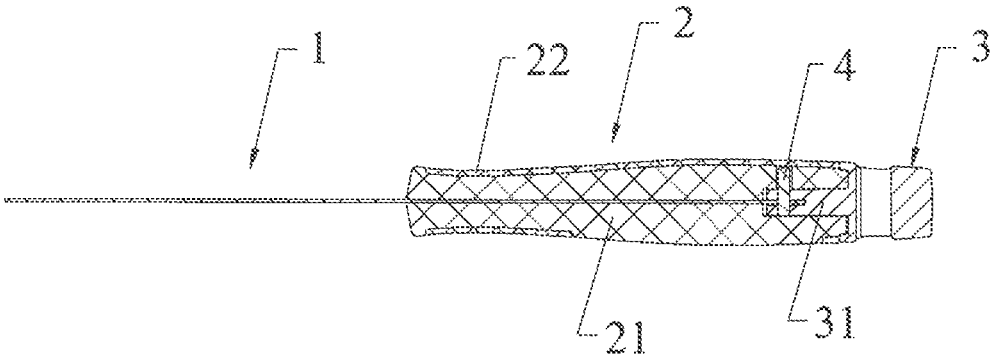
FIG. 4 is a cross-sectional view of the bottom view of the scraper of FIG. 1.

As shown in FIG. 4, when the blade 1 with the handle 2 is assembled with the knocking unit 3, the knocking unit 3 is mounted on a knocking unit end 211 of the handle 2. The recess 32 of the knocking unit 3 accommodates part of the handle end 12 of the blade 1 so that the through hole 13 of the blade 1 is in alignment with the through holes 33 of the knocking unit 3. The blade 1 and the knocking unit 3 are connected together via a pin 4 mounted into the through hole 13 and the through holes 33.

Generally, due to problems such as production precision and limiting, it is difficult to ensure reliable connections among the blade 1, the handle 2 and the knocking unit 3 at the same time during the assembly, i.e. it is difficult to ensure that there is no large displacement among the three. In prior art, reliable connection between the handle 2 and the knocking unit 3 is usually ensured, while there is certain gap between the blade 1 and the knocking unit 3. However, when the knocking unit 3 of a product with such design is used for knocking, the force generated at the knocking unit 3 is transferred via the handle 2, rather than transferred directly from the blade 1 to the knocking unit 3.

Figure 5:
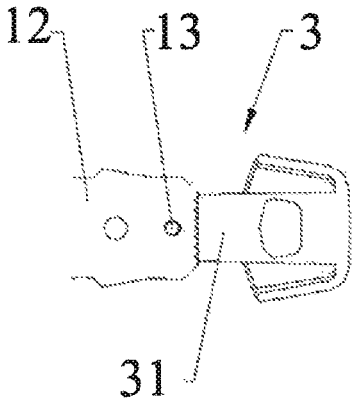
FIG. 5 is a cross-sectional view of the front view of the connection between the knocking unit and the blade of the scraper of FIG. 1.

In order to solve this problem, the contacting part between the blade 1 and the knocking unit 3 of the present invention is designed as a deformable and non-rigid contact. In this specific embodiment, the handle end face 121 is configured to be tooth-shaped; and when the knocking unit 3 is assembled onto the handle 2, the axis of the through hole 13 of the blade 1 is offset from that of the through holes 33 of the tongue part 31 of the knocking unit 3; and the axis of the through holes 33 of the knocking unit 3 is away from the working end 11 of the blade 1 with respect to that of the through hole 13 of the blade 1. There is certain gap between the blade 1 and the knocking unit 3, when a force is applied onto the knocking unit 3 and the handle 2, the tooth-shape of the handle end face 121 of the blade 1 is deformed so that the gap between the blade 1 and the knocking unit 3 disappears, as shown in FIG. 5. The pin 4 is then assembled to complete the reliable and fixed connections among the blade 1, the handle 2 and the knocking unit 3.

By this design, reliable connections among the blade 1, the handle 2 and the knocking unit 3 are achieved and meanwhile the requirement of the machining precision of the three is lowered. In addition, the tooth-shape can be designed in different shapes according to different materials of different hand tools so as to achieve the above reliable connections.

Figure 6:
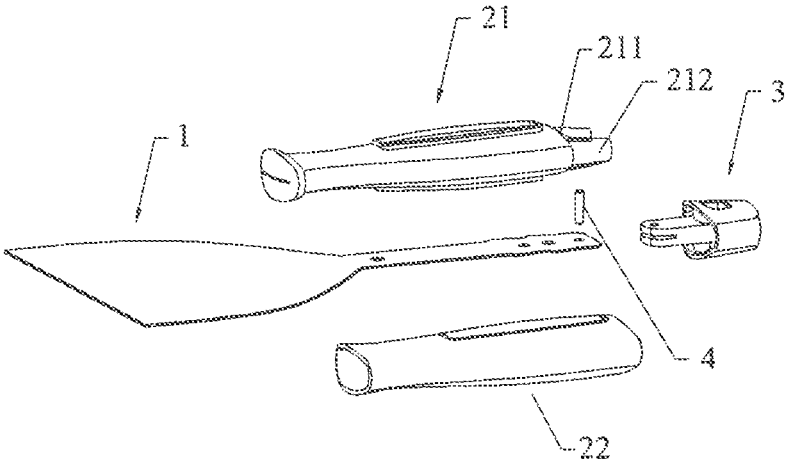
FIG. 6 is an exploded view of the blade of the scraper of FIG. 1.

As shown in FIG. 6, the handle 2 comprises a handle main body 21 and a soft cover 22. The knocking unit end 211 of the handle main body 21 has a mounting part 212 extending outward having a symmetric structure and being situated on both sides of the handle. The knocking unit 3 can accommodate the mounting part 212 of the handle 2, strengthening the assembly stability between the handle 2 and the knocking unit 3. The soft cover 22 is sheathed on the outer part of the handle main body 21 so that a flat outer surface is formed by the handle 2 and the knocking unit 3.

The material of the soft cover 22 can be rubber, on which patterns can be configured so as to improve the handfeel and antiskid property. It is known to other skilled persons in the art that the handle main body 21 can be made in other ways that will not be explained in detail here.

In this specific embodiment, when the knocking unit 3 of the scraper is used for knocking, the impact force is directly transferred from the knocking unit 3 to the blade 1, which significantly reduces the impact force transferred to the handle 2 so that reduces the damage to the handle.

FIGS. 7-10 show another preferred embodiment of the present invention, wherein the connection between the blade 1 and the knocking unit 3 is a snap-fit hook.

Figure 7:
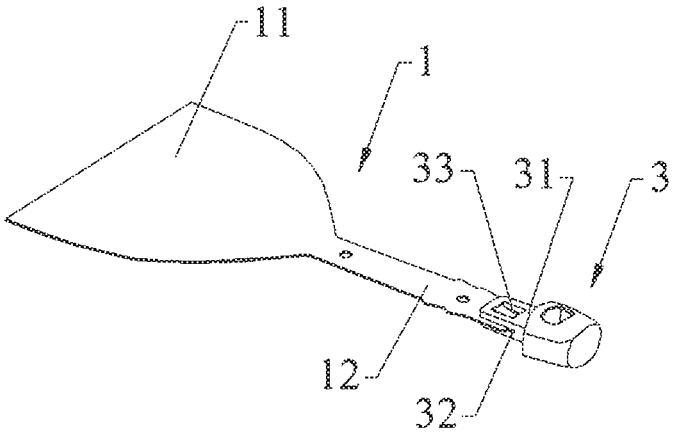
FIG. 7 is a schematic of the connection between the blade and the knocking unit of another preferred embodiment of a scraper of the present invention.
Figure 8:
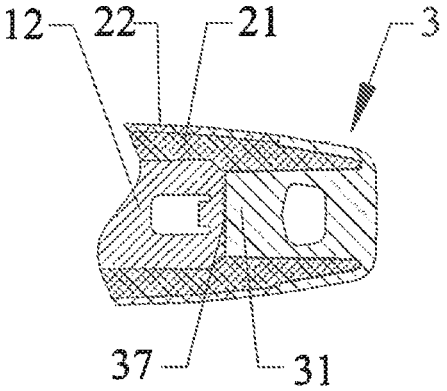
FIG. 8 is a partial cross-sectional view of the front view of the scraper of FIG. 7.
Figure 9:
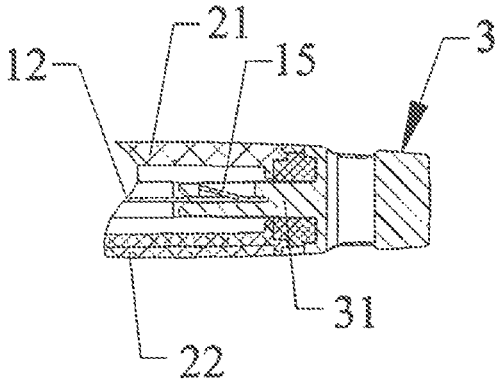
FIG. 9 is a partial cross-sectional view of the bottom view of the scraper of FIG. 7.

As shown in FIGS. 7-9, the knocking unit 3 comprises a tongue part 31 extending outward along the axis of symmetry, the tongue part 31 has a recess 32 at the end near the blade 1 for accommodating part of the handle end 12 of the blade 1. The closed end of the recess 32 is a contacting surface 37. A square open hole 33 is provided on the tongue part on one side of the recess 32. The edge of the square open hole 33 near the blade 1 is configured to be a slope, which forms an acute angle with the plane of the recess 32.

The handle part 12 of the blade 1 has a turnup part 15, an end of the turnup part 15 close to the handle end face 121 connects with the blade, an end away from the handle end face 121 turns up from the blade 1. The turnup part 15 fits with the square open hole 33 of the knocking unit 3.

When the blade 1 with the handle 2 is assembled with the knocking unit 3, the knocking unit 3 is pushed into the handle 2. At this time, the turnup part 15 of the blade 1 will be deformed towards the blade 1 by the edge of the square open hole 33. After it enters the square open hole 33, the deformed part recovers along the slope of the square open hole 33 and thereby connects the blade 1 and the knocking unit 3 together.

In an ordinary design, the problem mentioned in the first embodiment also exists in this connection, i.e. there is certain gap between the blade 1 and the knocking unit 3, when the knocking unit 3 is used for knocking, the force generated at the knocking unit 3 is directly transferred by the handle 2 rather than effectively transferred to the blade 1.

In this specific embodiment, the handle end face 121 of the blade 1 is configured to be tooth-shaped, when the knocking unit 3 is assembled onto the handle 2, the connection between the blade and the knocking unit 3 is a snap-fit hook. There is certain gap between the blade 1 and the knocking unit 3. When a force is applied to the knocking unit 3 and the handle 2, the handle end face 121 of the blade 1 is deformed so that the gap between the blade 1 and the knocking unit 3 completely disappears, as shown in FIG. 8. At this moment, the knocking unit 3 displaces towards the handle 2, the deformed turnup part 15 further recovers and abuts on the slope of the square open hole 33 forming a closer snap-fit and maintaining a gapless engagement between the handle end face 121 of the blade 1 and the contacting surface 37 of the knocking unit 3, and thereby realize a reliable connection among the blade 1, the handle 2 and the knocking unit 3.

Similarly, the tooth-shape can be designed in different shapes according to different materials of different hand tools so as to achieve the above reliable connections.

Figure 10:
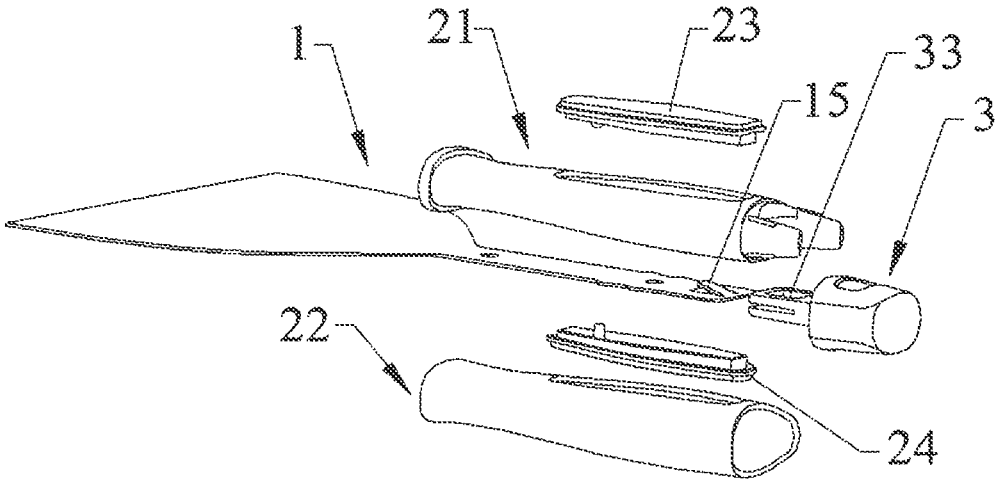
FIG. 10 is an exploded view of the scraper of FIG. 7.

As shown in FIG. 10, the handle 2 comprises a handle main body 21 and a soft cover 22, which are assembled in the same way as the previous preferred embodiment. The soft cover 22 is sheathed on the handle main body 21 and the surface of the whole handle is flat. In addition, the handle 2 may comprise an upper cap 23 and a lower cap 24 on which patterns may be configured so as to increase the friction between the user's hand and the handle; trademarks may also be configured.

In this specific embodiment, when the knocking unit 3 of the scraper is used for knocking, the impact force is directly transferred from the knocking unit 3 to the blade 1, which significantly reduces the impact force that transferred to the handle 2 so that the damage to the handle is reduced.

Figure 11:
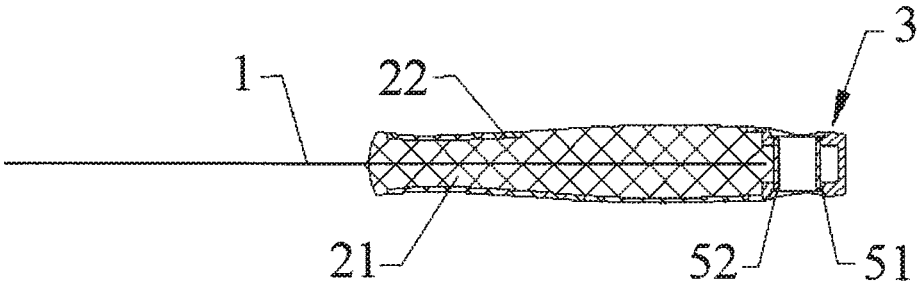
FIG. 11 is a cross-sectional view of the bottom view of another preferred embodiment of a scraper of the present invention.
Figure 12:
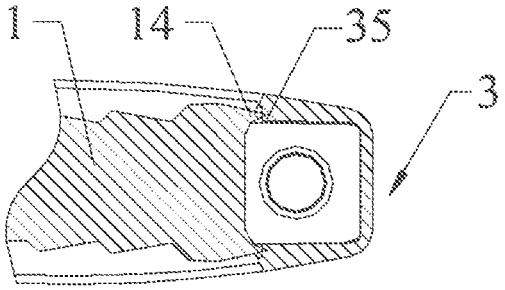
FIG. 12 is a partial cross-sectional view of the front view of the scraper of FIG. 11.
Figure 13:
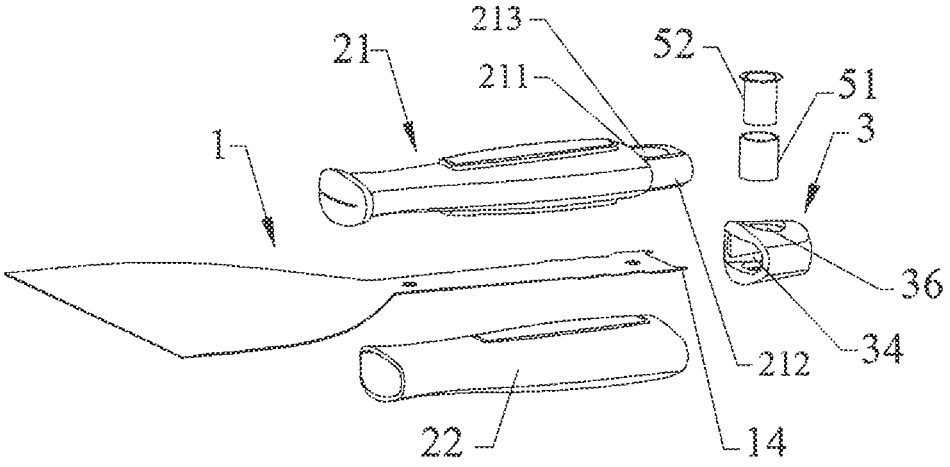
FIG. 13 is an exploded view of the scraper of FIG. 11.

FIGS. 11-13 show another preferred embodiment of the present invention, the connection among the blade 1, the handle 2 and the knocking unit 3 is a rivet connection.

As shown in FIGS. 11-12, the tail of the handle end 12 of the blade 1 is configured to be U-shaped, the protruded part of the U-shape is an extended part 14.

As shown in FIG. 13, the knocking unit end 211 of the handle main body 21 of the handle 2 has a mounting part 212 extending outward, the mounting part 212 has a through hole 213. The knocking unit 3 has a cavity 34 that can accommodate the mounting part 212, a contacting surface 35 contacting the extended part 14 of the blade 1 is provided on both sides of the cavity 34. In addition, a through hole 36 is provided on the knocking unit.

When the blade 1 with the handle 2 is assembled with the knocking unit 3, the knocking unit 3 is assembled to the mounting part 212 of the handle 2 via the cavity 34 so that the through hole 213 of the mounting part 212 is in alignment with the through hole 36 of the knocking unit 3; an annular tube 51 is mounted to the through hole 213 and the through hole 36 so that the blade 1, the handle 2 and the knocking unit 3 are connected together.

In an ordinary design, the problem mentioned in the first embodiment also exists in this connection, i.e. there is certain gap between the extended part 14 of the blade 1 and the contacting surface 35 of the knocking unit 3, when the knocking unit 3 is used for knocking, the force generated at the knocking unit 3 is directly transferred by the handle 2 rather than effectively transferred to the blade 1.

In this specific embodiment, the extended part 14 of the blade 1 is configured to be tooth-shaped, which can have either single or multiple teeth. When the blade 1 with the handle 2 is assembled with the knocking unit 3, the axis of the through hole 213 of the mounting part 212 of the handle 2 is offset from that of the through hole 36 of the knocking unit 3, and the axis of the through holes 213 is closer to the working end 11 of the blade 1 with respect to that of the through hole 36. There is certain gap between the extended part 14 of the blade 1 and the contacting surface 35 of the knocking unit 3, when a force is applied onto the knocking unit 3 and the handle 2, the tooth-shape of the extended part 14 of the blade 1 is deformed so that the gap between the extended part 14 of the blade 1 and the contacting part 35 of the knocking unit 3 disappears, as shown in FIG. 12. The annular tube 51 is then assembled into the through hole 213 and the through hole 36; and a rivet tube 52 is assembled into the annular tube 51 the so as to complete the reliable and fixed connections among the blade 1, the handle 2 and the knocking unit 3.

In addition, the tooth-shape can be designed in different shapes according to different materials of different hand tools so as to achieve the above reliable connections.

The handle 2 further comprises a soft cover 22 sheathed on the handle main body 21 so that a flat surface of the handle is formed after assembly.

In this specific embodiment, the annular tube has certain thickness and strength, which can bear the impact force transferred from the knocking unit 3. When the knocking unit 3 of the scraper is used for knocking, the impact force is transferred from the knocking unit 3 to the annular tube 51, and meanwhile also to the blade 1, which significantly reduces the impact force transferred to the handle 2 so that reduces the damage to the handle.

In an ordinary hand tool, the connection between the working unit and the knocking unit is unreliable, i.e. there is certain gap between the handle end of the working unit and the knocking unit so that the impact force experienced by the knocking unit cannot be effectively dispersed to the working part thus the handle is easy to be damaged. While in the present invention, a gapless engagement between the working unit and the knocking unit is formed by the deformation between the handle end of the working unit and the contacting surface of the knocking unit. This configuration lowers the precision requirements for the production of each part of the hand tool, also effectively lowers the production costs and is beneficial for the fine-tuning of the product. Therefore, the hand tool of the present invention has reliable connections that can disperse the impact force and prolong the service life of the handle.

The invention has been exemplified above with reference to specific embodiments. However, it should be understood that a multitude of modifications and varieties can be made by an ordinary person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A hand tool with reliable connections, comprising:

a working unit having a working end and a handle end opposite to the working end;

a handle being mounted on the handle end of the working unit and having a working unit end and a knocking unit end;

a knocking unit mounted on the knocking unit end of the handle;

wherein a connecting part between the knocking unit and the handle end of the working unit is a contacting surface, the handle end or the contacting surface being configured as a deformable and non-rigid contact, realizing the reliable connection between the working unit and the knocking unit;

wherein at least one of the contacting surface and the handle end is configured to be tooth-shaped, the tooth-shape can be deformed so as to form a gapless engagement with the contacting surface;

wherein the knocking unit has a tongue part having a recess for accommodating part of the handle end, a closed end of the recess being the contacting surface; and wherein the handle end has a turnup part, a through hole engaged with the turnup part is configured on the tongue part of the knocking unit, and the working unit and the knocking unit are fixedly connected by the turnup part and the through hole.

2. The hand tool with reliable connections of claim 1, wherein the turnup part is configured to connect with the handle end of the working unit on the end close to the knocking unit and turn up from the working unit on the end away from the knocking unit.

3. The hand tool with reliable connections of claim 2, wherein the through hole is a square hole with a slope configured on the part contacting the turnup part.

4. The hand tool with reliable connections of claim 3, wherein the end turning up from the knocking unit of the turnup part displaces along the slope because of the deformation of the tooth-shape under an external force so as to fixedly connect the working unit and the knocking unit.

5. The hand tool with reliable connections of claim 1, wherein the working unit is a blade.

6. The hand tool with reliable connections of claim 1, wherein the material of the knocking unit of the handle is metal or high strength polymer.

* * * * *